US005762338A

United States Patent [19]

Hutchison

[11] Patent Number: 5,762,338

[45] Date of Patent: Jun. 9, 1998

[54] FOOTBALL GAME

[76] Inventor: Kevin Eugene Hutchison, 1345 Nancy Sue Dr., Lima, Ohio 45806

[21] Appl. No.: 871,187

[22] Filed: Jun. 9, 1997

[51] Int. Cl.[6] ..... A63F 3/00

[52] U.S. Cl. ..... 273/247; 273/277

[58] Field of Search ..... 273/242, 243, 273/244, 247, 277

[56] References Cited

U.S. PATENT DOCUMENTS

| | | | |
|---|---|---|---|
| 2,520,668 | 8/1950 | Wheeler | 273/247 X |
| 3,947,039 | 3/1976 | Sadler et al. . | |
| 4,003,580 | 1/1977 | Haffey, Jr. . | |
| 4,168,834 | 9/1979 | Mangiarelli | 273/247 |
| 4,183,529 | 1/1980 | Hynson | 273/247 X |
| 5,039,107 | 8/1991 | Jackson . | |
| 5,040,796 | 8/1991 | Schall . | |
| 5,158,301 | 10/1992 | Martukovich, Jr. . | |
| 5,217,229 | 6/1993 | Jaime | 273/247 |
| 5,405,141 | 4/1995 | Wilkes . | |
| 5,496,036 | 3/1996 | Chester | 273/247 |

*Primary Examiner*—William E. Stoll

*Attorney, Agent, or Firm*—Killworth, Gottman, Hagan & Schaeff, L.L.P.

[57] ABSTRACT

An amusement device for simulating the strategy and results of a real football game is provided. The football game includes a backfield section and a downfield section. The offensive team selects running plays by selecting a starting rush position along a line of scrimmage within the downfield section and a rush direction position along a secondary also within the downfield section. The offensive team selects passing plays by selecting a starting passing position in the backfield section and a pass reception position in the downfield section. The defensive team selects a defensive play in which to stop the anticipated offensive play by placing a number of markers in desired positions in the backfield and downfield section. The result of the play is determined based on yardage charts and the selected offensive and defensive plays.

20 Claims, 5 Drawing Sheets

| RUSH PLAY | 3 MARKERS ON SRP (64) | 2 MARKERS ON SRP (62) | 1 MARKER ON SRP (60) | 0 MARKERS ON SRP (66) | 0 MARKERS ON RDP (68) | 0 MARKERS ON FRP, AND ≥ 2 MARKERS ON 2ND SEC. (70) | 0 MARKERS ON FRP, AND 1 MARKER ON POSITION ADJACENT FRP (72) | 0 MARKERS ON 2ND SECONDARY, OR 0 MARKERS ON FRP AND ≤ 1 MARKER ON 2ND SECONDARY AND 0 MARKERS ON POSITION ADJACENT FRP. (74) |
|---|---|---|---|---|---|---|---|---|
| 1-6 (9) | FUMBLE | -3 YDS | 0 YDS | 6 YDS | 15 YDS | 30 YDS | 50 YDS | TD |
| 2-6 (9) | FUMBLE | -2 YDS | 0 YDS | 4 YDS | 15 YDS | 30 YDS | 50 YDS | TD |
| 2-7 (10) | FUMBLE | -2 YDS | 0 YDS | 4 YDS | 12 YDS | 25 YDS | 45 YDS | TD |
| 3-7 (10) | FUMBLE | -2 YDS | 0 YDS | 4 YDS | 12 YDS | 25 YDS | 45 YDS | TD |
| 4-7 (10) | FUMBLE | -2 YDS | 0 YDS | 4 YDS | 12 YDS | 25 YDS | 45 YDS | TD |
| 4-8 (11) | FUMBLE | -2 YDS | 0 YDS | 4 YDS | 15 YDS | 30 YDS | 50 YDS | TD |
| 5-8 (11) | FUMBLE | -3 YDS | 0 YDS | 6 YDS | 15 YDS | 30 YDS | 50 YDS | TD |

-1 YD ADDED TO A NO GAIN OR LOSS

FOR EVERY POINT IN BACKFIELD SECTION

FIG. 4

| PASS PLAY | 76<br>0 MARKERS ON PRP | 78<br>0 MARKERS ON PRP OR FPP AND ≥ 2 MARKERS ON 2ND SECONDARY | 80<br>0 MARKERS ON PRP OR FPP AND 1 MARKER ON ADJACENT FRP OR FPP | 82<br>0 MARKERS ON 2ND SECONDARY, OR 0 MARKERS ON PRP OR FPP AND ≤ 1 MARKER OF 2ND SECONDARY AND 0 MARKERS ON POSITION ADJACENT PRP OR FPP |
|---|---|---|---|---|
| TO 6 (9). 8 (11) | 15 YDS | 30 YDS | 50 YDS | TD |
| TO 7 (10) | 12 YDS | 25 YDS | 45 YDS | TD |
| TO 9, 11 | | 30 YDS | 50 YDS | TD |
| TO 10 | | 25 YDS | 45 YDS | TD |

FIG. 5

| SACK |
|---|
| POSITION A = -4 YDS |
| POSITIONS B, C, D = -8 YDS |
| POSITION E = -12 YDS |

FIG. 6

| | NO BLITZ | BLITZ |
|---|---|---|
| SCREEN PLAY | -8 TDS | +8 YDS |
| DRAW PLAY | -6 YDS | +6 YDS |

FIG. 7

10 YD LINE AND CLOSER TO GOAL LINE
ALL PLAYS = LINE OF SCRIMMAGE 4 YDS
1ST SECONDARY 6 YDS
2ND SECONDARY 10 YDS

FIG. 9

FIELD GOAL

1 → 5 YD LINE = 1 MARKER ON DOWNFIELD SECTIONS
6 → 10 YD LINE = 2 MARKERS ON DOWNFIELD SECTIONS
11 → 15 YD LINE = 3 MARKERS ON DOWNFIELD SECTIONS
16 → 20 YD LINE = 4 MARKERS ON DOWNFIELD SECTIONS
21 → 25 YD LINE = 5 MARKERS ON DOWNFIELD SECTIONS
26 → 30 YD LINE = 6 MARKERS ON DOWNFIELD SECTIONS
31 → 35 YD LINE = 6 MARKERS ON LINE OF SCRIMMAGE AND 1ST SECONDARY
36 → 40 YD LINE = 4 MARKERS ON LINE OF SCRIMMAGE

FIG. 8

FOOTBALL GAME

BACKGROUND OF THE INVENTION

This invention relates generally to amusement devices, and, more particularly, to an apparatus and method for simulating the playing of football.

The game of football is one of the most popular games in the United States. As a natural outgrowth of the popularity of football, numerous board games have been developed to simulate the game of football. Generally, such games are merely games of chance with both contestants having an equal opportunity to win. Skill and strategy play little part in the outcome of such games.

The difficult aspect of a football game is to provide some means to allow a player or coach to use strategy similar to the strategy used in the actual game of football and for that strategy to yield similar results. Prior art football games generally combine chance, in the form of dice, spinners, cards and the like, with a limited amount of strategy in order to determine the outcome of each play, and hence, the game. The strategy inherent with the actual game of football tends to be lost in the game pieces used to play the simulated game.

There is thus a need for a football game which simulates the strategy and results of a real football game which is also easy to play and inexpensive to manufacture.

SUMMARY OF THE INVENTION

The invention of the present application meets this need by providing a football game which simulates the strategy and results of a real football game. Offensive and defensive plays are selected using similarly configured play boards, each having a backfield section and a downfield section. Rushing plays comprise selecting a starting rush position in one of the downfield sections and a rush direction position in another of the downfield sections. Passing plays comprise selecting a starting pass position in one of the backfield sections and a reception position in one of the downfield sections. Each defensive play comprises selecting a desired combination of defensive positions in the backfield and downfield sections to anticipate the selected offensive play. The result of a down is determined from the selected offensive and defensive plays and a yardage chart.

According to a first aspect of the present invention, a football game apparatus comprises an offensive play board and a defensive play board each having a backfield section and a downfield section. The backfield section includes a plurality of first play areas and the downfield section includes a plurality of second play areas. An offensive play indicator is included for selecting a selected offensive play on the offensive play board from a plurality of offensive plays, including passing plays and rushing plays. Each passing play comprises a starting pass position in one of the first play areas and a reception position in one of the second play areas, and each rushing play comprises a starting rush position in one of the second play areas and a rush direction position in another of the second play areas. A defensive play indicator is provided for selecting a selected defensive play on the defensive play board from a plurality of defensive plays. Each defensive play comprises a desired combination of defensive positions within the first and second play areas in which to defend against the offensive play. Results of a down are determined from the selected offensive play and the selected defensive play.

The plurality of first play areas may comprise a first row having one position, a second row having three positions and a third row having one position. The plurality of second play areas may comprise a line of scrimmage having five positions, a first secondary having three positions and a second secondary having three positions. The plurality of offensive plays may comprise a field goal play. The offensive play indicator may be used to select one of the first and second play areas for the field goal play based on a required distance for completion of the field goal. The defensive play indicator may be used to select a predetermined number of the first and second play areas in which to defend against the field goal play based on the required distance for completion of the field goal. The field goal is successful if the area indicated by the offensive play indicator does not match any of the first and second play areas selected to defend against the field goal play. The desired combination of defensive positions may equal six.

The apparatus may further comprise a game board. The game board may comprises a scoreboard portion and a field portion representing a football field. The scoreboard portion indicates a score for a home team and a visiting team, current down, and a time clock including current quarter and plays within the current quarter. The field portion indicates current field position and first down position.

The defensive play board may comprise a sheet of magnetically attractive material and the defensive play indicator may comprise a plurality of magnetically attractive tokens for attachment to the defensive play board. The offensive play board may comprise an erasable board and the offensive play indicator may comprise a writing instrument having erasable ink.

According to another aspect of the present invention, a football game apparatus comprises a game board. The game board comprises a scoreboard portion and a field board portion representing a football field. The scoreboard portion indicates a score for a home team and a score for a visiting team, current down, and a time clock including current quarter and plays within the current quarter. The field portion indicates current field position and first down position. An offensive play board having a backfield section and a downfield section is included. A defensive play board is included having a backfield section and a downfield section. The backfield section of each play board includes a plurality of first play areas and the downfield section of each play board includes a plurality of second play areas. The plurality of first play areas comprises a first row having one position, a second row having three positions and a third row having one position. The plurality of second play areas comprises a line of scrimmage having five positions, a first secondary having three positions and a second secondary having three positions. An offensive play indicator is used to identify a selected offensive play on the offensive play board. The selected offensive play being one of a plurality of passing play and rushing plays. A defensive play indicator is used for identifying a selected defensive play on the defensive play board. A passing play is selected using the offensive play indicator to indicate a starting pass position in one of the first play areas and a reception position in one of the positions in the first and second secondaries. A rushing play is selected using the offensive play indicator to a indicate a starting rush position in one of the positions of the line of scrimmage and a rush direction position in one of the positions of the first secondary. A defensive play is selected using the defensive play indicator to indicate a desired combination of defensive positions within the first and second play areas to defend against the offensive play. The desired combination of defensive positions equals six. The result of a down is determined from the selected offensive and defensive plays.

According to yet another aspect of the present invention, a method for playing a football game comprises providing an offensive play board having a plurality of first play areas in a backfield section and a plurality of second play areas in a downfield section. A defensive play board is provided having a plurality of first play areas in a backfield section and a plurality of second play areas in a downfield section. A desired offensive play is selected on the offensive play board by identifying at least one play area from the total of the first and second play areas. A desired defensive play is selected on the offensive play board by identifying a desired combination of the first and second play areas as defensive positions. A result of a down is determined in response to the selected offensive play and the selected defensive play.

The act of selecting a desired offensive play may comprise the act of selecting a passing play using the offensive play indicator to select a starting pass position in one of the first play areas and a reception position in one of the second play areas. The act of selecting a desired offensive play may comprise the act of selecting a rushing play using the offensive play indicator to select a starting rush position in one of the second play areas and a rush direction position in another of the second play areas. The act of determining the result of a down may comprise the act of determining the result electronically. The desired combination of defensive positions may equal six.

The act of determining the result of a down may comprise the act of determining a result of the passing play based on the following criteria: the pass is complete for a predetermined number of yards if the defensive play does not include defensive positions on both of the starting pass position and the reception position; the pass is incomplete if the defensive play includes at least one defensive position on the reception position; the pass results in a sack for a loss of a predetermined number of yards if the defensive play includes at least one defensive position on the starting pass position; and the pass results in a turnover for any combination of three defensive positions on the starting pass position and the reception position. The pass may be complete for a greater predetermined number of yards if the defensive play does not include defensive positions on the starting pass position, the reception position and a final pass position, the final pass position being adjacent and upfield from the final pass position.

The act of determining the result of a down may comprise the act of determining a result of the rushing play based on the following criteria: the rush results in a gain of a predetermined number of yards if the defensive play does not include at least one defensive position on the starting rush position; the rush results in a gain of a greater predetermined number of yards if the defensive play does not include defensive positions on either of the starting rush position and the rush direction position; the rush results in a zero gain if the defensive play includes one defensive position on the starting rush position; the rush results in a loss of a predetermined number of yards if the defensive play includes two defensive positions on the starting rush position; and the rush results in a turnover if the defensive play includes three defensive positions on the starting rush position. The rush results in a gain of an even greater predetermined number of yards if the defensive play does not include defensive positions on the starting rush position, the rush direction position and a final rush position, the final rush position being adjacent and upfield from the rush direction position.

The act of selecting a desired offensive play may further comprise the act of selecting a field goal play using the offensive play indicator to select one of the first and second play areas for the field goal play based on a required distance of the field goal. The defensive play indicator may be used to select a predetermined number of the first and second play areas in which to defend against the field goal play based on the required distance of the field goal. The act of determining the result of a down comprises the act of determining a result of the field goal play. The field goal is successful if the area indicated by the offensive play indicator does not match any of the predetermined areas indicated by the defensive play indicator.

The plurality of first play areas may comprise a first row having one position, a second row having three positions and a third row having one position. The plurality of second play areas may comprise a line of scrimmage having five positions, a first secondary having three positions and a second secondary having three positions. The act of selecting a pass play may comprise the act of selecting the starting pass position from one of the five positions in the first play area and the reception position in one of the positions in the first and second secondaries. The act of selecting a rushing play may comprises the act of selecting the starting rush position in one of the positions of the line of scrimmage and the rush direction position in one of the positions of the first secondary.

Other objects and advantages of the invention will be apparent from the following description, the accompanying drawings and the appended claims.

BRIEF DESCRIPTION OF THE DRAWINGS

FIG. 4 is a rushing yardage chart in accordance with an embodiment of the present invention;

FIG. 5 is a passing yardage chart in accordance with an embodiment of the present invention;

FIG. 6 is a sack yardage chart in accordance with an embodiment of the present invention;

FIG. 7 is a screen and draw play yardage chart in accordance with an embodiment of the present invention;

FIG. 8 is a field goal chart in accordance with an embodiment of the present invention; and FIG. 9 is a yardage chart for plays within the opponent's 10 yard line in accordance with an embodiment of the present invention.

DETAILED DESCRIPTION OF THE INVENTION

Figure 2:
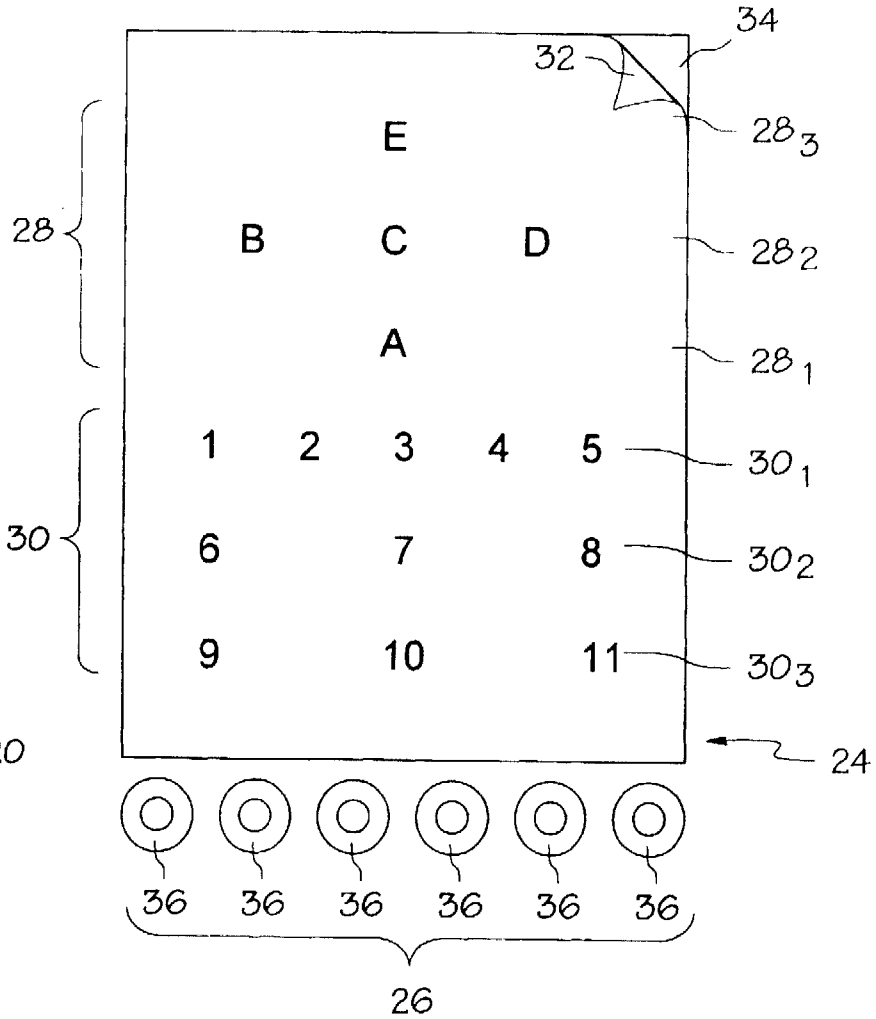
FIG. 2 is a plan view of a defensive play board and indicator in accordance with an embodiment of the present invention.
Figure 1:
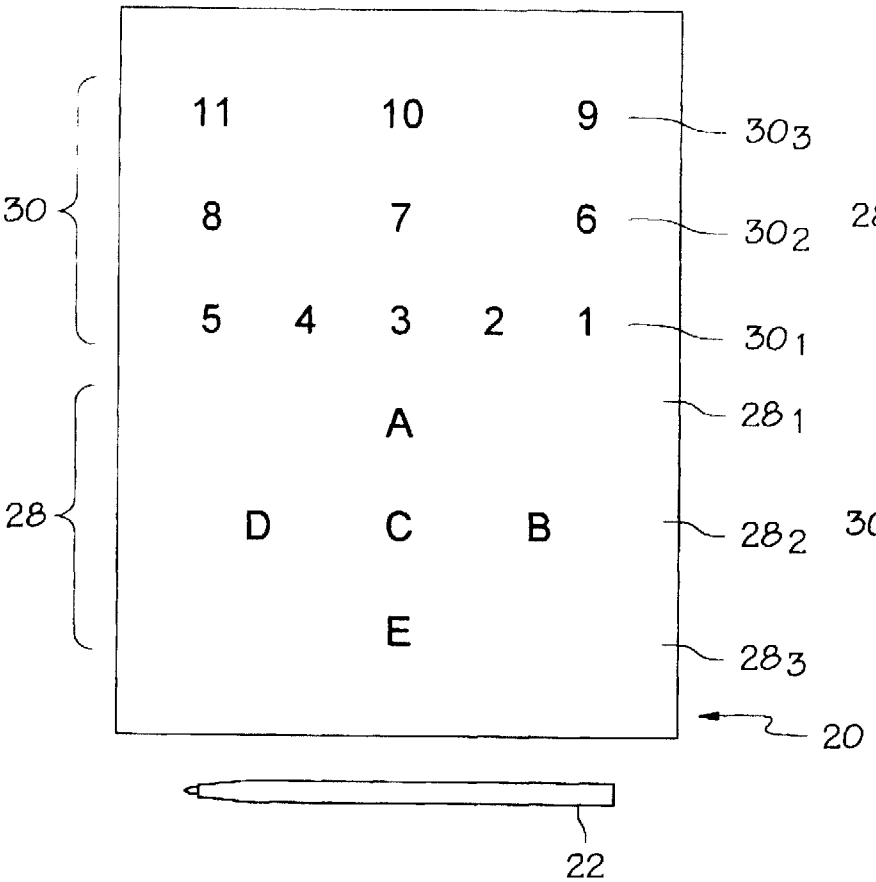
FIG. 1 is a plan view of an offensive play board and indicator in accordance with an embodiment of the present invention.

Reference is made to FIGS. 1 and 2, illustrating an embodiment for the football game according to the present invention. The football game includes an offensive play board 20, an offensive play indicator 22, a defensive play board 24 and a defensive play indicator 26. The offensive play board 20 and the defensive play board 24 are similarly configured to include a backfield section 28 and a downfield section 30. The backfield section 28 includes a plurality of first play areas A-E having a diamond shape and arranged in three rows $\mathbf{28_1}$, $\mathbf{28_2}$ and $\mathbf{28_3}$ with position A in the first row $\mathbf{28_1}$, positions B, C and D in the second row $\mathbf{28_2}$ and position E in the third row $28_3$. The downfield section 30 includes a plurality of second play areas 1–11 with positions 1–5 occupying a line of scrimmage $30_1$, positions 6–8 occupying a first secondary $30_2$ and positions 9–11 occupying a second secondary $30_3$.

In the illustrated embodiment, the offensive game board 20 comprises an erasable board while the offensive play indicator 22 comprises a pen with erasable ink for use with the erasable board. The printed matter for the backfield and downfield sections 28 and 30 are permanently affixed or printed on the board 20 using conventional methods. An offensive play is selected by writing on the offensive play board 20 with the offensive play indicator 22. Once the result of the play is determined as described herein, the offensive play board 20 is erased using conventional methods so that a new play may be selected.

The defensive play board 24, in the illustrated embodiment, comprises a first board 32 or board layer laminated to a second board 34 using conventional methods. The first board 32 includes printed matter for the backfield and downfield sections 28 and 30 which are also permanently affixed or printed using conventional methods. The second board 34 comprises magnetically attractive material, such as steel. The defensive play indicator 26 includes a plurality of markers 36 which are magnetic or include a magnet or magnetic portion for attaching the markers 36 to the board 24. A defensive play is selected by applying the appropriate number of markers 36 to the board 24 as described herein. The markers 36 may be stacked on top of one another so that multiple markers 36 may occupy a single position on the board 24 which effects the result of the play as described herein. Once the play is complete, the markers 36 may be rearranged to select a new defensive play.

It will be appreciated by those skilled in the art that the first board 32 may be made of any suitable material for accepting the printed matter and for lamination to the second board 34. It will be further appreciated by those skilled in the art that the second board 34 may be comprised of other magnetically attractive materials other than steel. Further, the offensive play board 20 and/or the defensive play board 24 and markers 36 may take a variety of other forms. For example, the boards 20, 24 may be formed as a hole and peg system, or a peg and ring system or the like. It is also contemplated that the football game of the present invention can be implemented in computer form so that the boards 20; 24 can take a wide variety of forms and appear on a visual display controlled by the computer.

Figure 3:
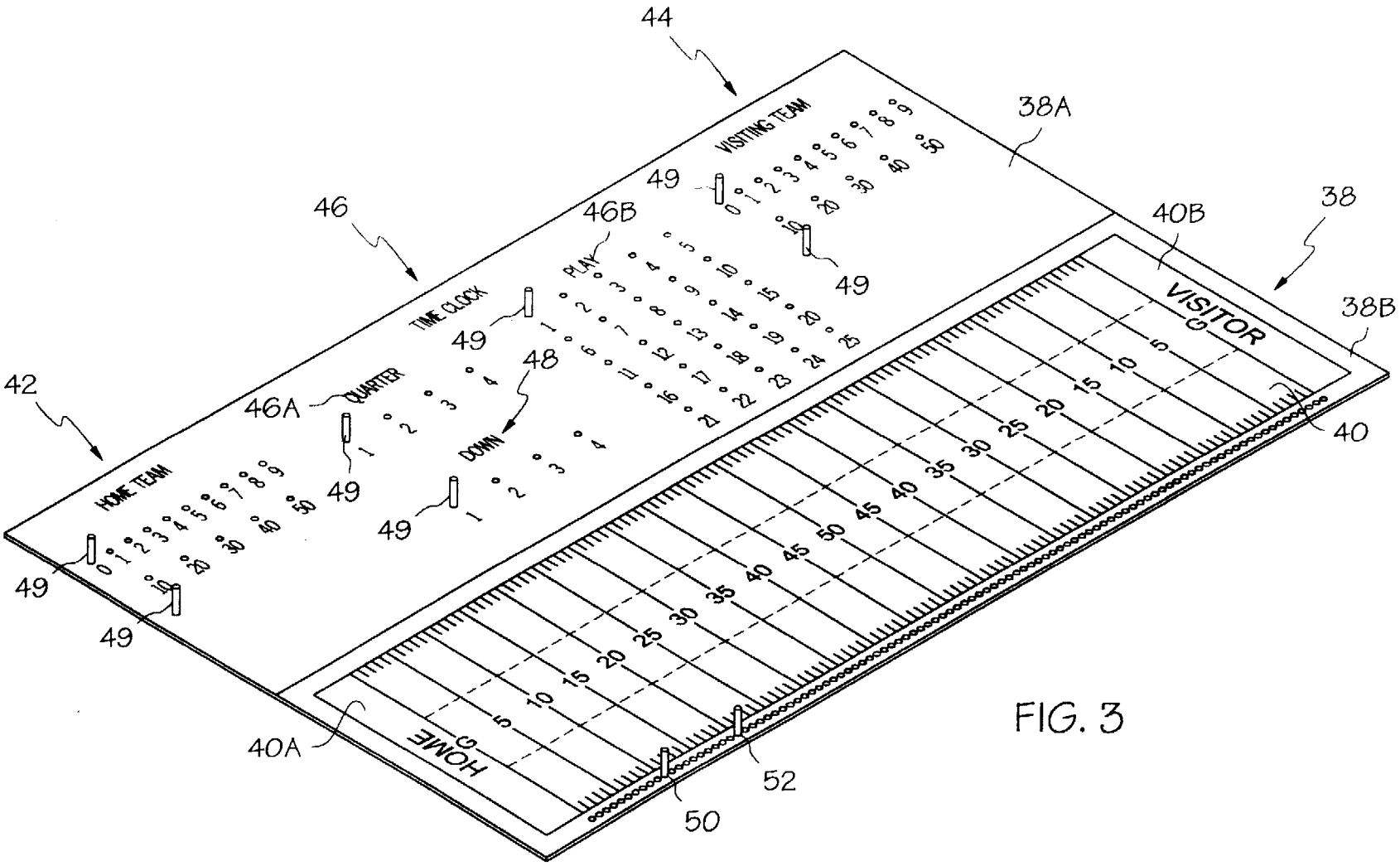
FIG. 3 is a plan view of a game board in accordance with an embodiment of the present invention.

The football game further comprises a game board 38 as shown in FIG. 3. The game board 38 includes a scoreboard portion 38A and a field portion 38B representing a football field 40. The scoreboard portion 38A includes a home team score portion 42, a visiting team score portion 44, a time clock portion 46 and a down indicator 48. The score portions 42 and 44 each include numerical designations for keeping track of the score of the game via markers 49. The time clock portion 46 includes a quarter indicator 46A and a play in quarter indicator 46B, each with numerical designations for keeping track of the quarter and the number of plays in the current quarter via markers 49.

The football field 40 is one hundred units long, representing one hundred yards, with a home goal 40A and a visitor goal 40B. The football field 40 includes yardage designations for each yard on the football field 40. The field portion 38B also includes a yard marker 50 for indicating the current field position and a first down marker 52 for indicating the first down position. In the illustrated embodiment, the game board 38 includes a hole for every numeric and yard designation, i.e. score, quarter, play in quarter, down, current field position and first down position, while the markers 49, 50 and 52 are pegs which fit into the holes. The markers 49, 50, and 52 may be moved from hole to hole to change each designation as appropriate. The markers 49, 50, and 52 may be comprised of different colors for ease of identification. It will be appreciated by those skilled in the art that a peg and ring system, a magnetic system as described above, a digital display for a computer implementation or other displays may be used to keep track of the scoreboard parameters, i.e. score, time, etc.

The football game is played as follows. The players select who is the home team and who is the visiting team using any desired method, preferably, by flipping a coin. The home team kicks to the visiting team to begin the game while the visiting team kicks to the home team to start the second half. The receiving team takes possession of the football at the 20 yard line. As with a real football game, the scoring team kicks off to the opposing team after every touchdown and extra point attempt and every successful field goal. The game continues with the players secretly selecting desired offensive and defensive plays, revealing the respective plays, determining the results of the play, and adjusting the score, time clock, down marker and yardage marker, as appropriate.

The defensive player selects a defensive play to try and stop the offensive play by secretly placing six markers 36 on the defensive play board 24. The defensive player may place the markers 36 in any combination in the backfield section 28 and downfield section 30 except that at least one position must be uncovered in each of the first and second secondaries $30_2$, $30_3$. Any marker 36 placed in the backfield section 28 of the defensive play board 24 represents a blitz by the defense. Each position which is thus designated by the markers 36 represents a position which is covered by the defense in an attempt to stop the play selected by the offense.

The offensive player selects either a running play or a passing play. A running play is selected by indicating a starting rush position (SRP) along the line of scrimmage 30, and a rush direction position (RDP) in the first secondary $30_2$. A sweep or end run play is selected by indicating starting rush positions 1 or 5 while an inside run play is selected by indicating starting rush positions 2, 3 or 4. The rush direction position must be adjacent to the starting rush position such that the following starting position-rush direction position combinations are available: 1–6; 2–6; 2–7; 3–7; 4–7; 4–8; and, 5–8.

The running play then continues ahead along a straight path to a finishing rush position (FRP) which is the only adjacent position in the second secondary 303 which is upfield from the first secondary $30_2$ position which defines the rush direction. For example, a running play with a starting rush position of 2 and a rush direction position of 6 corresponds to an inside run at position 2 with a jump to the outside at position 6 continuing upfield to finishing rush position 9, represented in FIG. 4 by 2–6 (9).

The result of the running play is determined based on the selected defensive play and the rushing yardage chart shown in FIG. 4. For example, the play is stopped for zero gain if there is a marker 36 on the same position as the starting rush position, see 60 in FIG. 4. Additionally, two markers 36 on the starting rush position results in a loss of yardage, see 62 in FIG. 4, and three markers 36 results in a fumble which, as for all fumbles is recovered by the defense, see 66 in FIG. 4. The rushing play is good for a predetermined number of yards if there are no markers 36 on the starting rush position, see 68 in FIG. 4. The rushing play is good for a greater predetermined number of yards if there are also no markers 36 on the rush direction position of the first secondary, see 68 in FIG. 4.

The rushing play is good for an even greater predetermined number of yards dependent upon the markers which are placed in the remaining second secondary positions. If there are no markers 36 on the finishing rush position of the second secondary $\mathbf{30}_3$ and two or more markers 36 in the remaining second secondary positions with at least one of those markers 36 on a second secondary position which is adjacent to the finishing rush position in the second secondary $\mathbf{30}_3$, the additional yardage is shown by 70 in FIG. 4. The rushing play is good for an even further predetermined number of yards if there is only one marker 36 on the remaining second secondary positions which marker is adjacent to the finishing rush position of the second secondary $\mathbf{30}_3$, see 72 in FIG. 4. The rushing play is good for a touchdown if there are no markers 36 in the finishing rush position of the second secondary $\mathbf{30}_3$ and only one marker 36 in the second secondary $\mathbf{30}_3$ which is not adjacent to the finishing rush position, see 74 in FIG. 4. A rushing play in which the defense has three or more markers 36 in the backfield section results in a zero gain, and a loss of yardage if there is at least one marker 36 on the starting rush position. There is also an additional loss of 1 yard for each marker 36 in the backfield section 28 when the rushing play results in a loss or no gain. However, there is no loss of yardage for each marker 36 in the backfield section 28 when three or more markers 36 in the backfield section 28 cause the no gain. The result of such a play is no gain.

In Examples 1–12, the offensive players calls a running play with start rushing position 4 and rushing direction 8.

EXAMPLE 1

There is one marker 36 on position 4. The play results in no gain.

EXAMPLE 2

There are two markers 36 in position 4. The play results in a loss of 2 yards.

EXAMPLE 3

There are three markers 36 in position 4. The play results in a fumble which, as with all fumbles, is recovered by the defensive team.

EXAMPLE 4

There is no marker 36 on position 4 and one marker 36 on position 8. The play results in a gain of 4 yards.

EXAMPLE 5

There is no marker 36 on positions 4 and 8 and one marker 36 on position 11. The play results in a gain of 15 yards.

EXAMPLE 6

There are no markers 36 on positions 4, 8 and 11 and one marker 36 on position 10 and one marker 36 on position 9. The play results in a gain of 30 yards.

EXAMPLE 7

There are no markers 36 on positions 4, 8 and 11. There are two markers 36 on position 10. The play results in a gain of 30 yards.

EXAMPLE 8

There are no markers 36 on positions 4, 8, 9 and 11. There is one marker 36 on position 10. The play results in a gain of 50 yards

EXAMPLE 9

There are no markers 36 on positions 4, 8, 10 and 11. There is one marker 36 on position 9. The play results in a touchdown.

EXAMPLE 10

There are no markers 36 on positions 4 and 8 and no markers 36 in the second secondary $\mathbf{30}_3$. The play results in a touchdown.

EXAMPLE 11

There is one marker 36 on position 4 and two markers in the backfield section 28. The play results in a loss of 2 yards.

EXAMPLE 12

There are no markers 36 on position 4 and three markers 36 in the backfield section 28. The play results in no gain.

A passing play is selected by indicating a starting pass position (SPP) in the backfield section 28 and a pass reception position (PRP) in one of the positions in the first and second secondaries $\mathbf{30}_2$, $\mathbf{30}_3$. Assuming that the pass is complete, the receiver continues to run directly upfield for possible additional yardage. The second secondary positions which are adjacent and upfield from the pass reception positions in the first secondary 30, are the same as the finishing rush positions of the rushing plays and are defined as finishing pass positions (FPPs). A pass to pass reception position 8 continues to finishing pass position 11, a pass to pass reception position 7 continues to finishing pass position 10 and a pass to pass reception position 6 continues to finishing pass position 9.

The result of the passing play is determined based on the selected defensive play and the passing yardage chart shown in FIG. 5. The pass is complete for a predetermined number of yards if there are no markers 36 on either the starting pass position or the pass reception position, see 76 and 78 in FIG. 5. The receiver may also run for additional yards under rules corresponding to the rules for a running play.

For example, assuming that the pass reception position is in the first secondary $\mathbf{30}_2$, the pass is complete for a greater predetermined number of yards if there are also no markers 36 in the finishing pass position and there are two or more markers in the other second secondary positions, see 78 in FIG. 5. The passing play is complete for an even further predetermined number of yards if there is only one marker 36 on the second secondary which marker 36 is adjacent to the finishing pass position, see 80 in FIG. 5. The passing play is complete for a touchdown if there are no markers 36 in the second secondary 303 or only one marker 36 in the second secondary which is not adjacent to the finishing pass position, see 82 in FIG. 5. Similarly, assuming that the pass reception position is in the second secondary $\mathbf{30}_3$, the receiver may run for additional predetermined yards if there is only one marker 36 on a second secondary position which is adjacent to the pass reception position or for a touchdown if there are no markers 36 in the second secondary 303 or no markers 36 in the second secondary adjacent to the pass reception position, see 80 and 82 in FIG. 5.

The pass is incomplete if there is a marker 36 on the pass reception position. The quarterback is sacked for a loss of a predetermined number of yards as shown in FIG. 6 if there is at least one marker 36 on the starting pass position. A turnover occurs if there is a total of three markers 36 associated with the starting pass position and the pass reception position. For example, a fumble results if there are three markers 36 on the starting pass position while an interception results if there are three markers 36 on the reception position. Similarly, a fumble results if there are two markers 36 on the starting pass position and one marker 36 on the reception position while an interception results if there is one marker 36 on the starting pass position and two markers 36 on the reception position. The position of the fumble or interception corresponds to the predetermined number of yards if the play had resulted in a sack or the predetermined number of yards if the play had resulted in a completion with no run, respectively. Further, a pass play cannot be completed to a position in the second secondary $\mathbf{30}_3$ when the total number of markers 36 in the backfield section 28 is three or greater.

In Examples 13–21, the offensive player calls a passing play with starting pass position C and pass reception position 8.

EXAMPLE 13

There is one marker 36 on position 8 and no markers 36 on position C. The play results in an incomplete pass.

EXAMPLE 14

There is one marker 36 on position C and no markers 36 on position 8. The play results in a sack and a loss of 8 yards.

EXAMPLE 15

There are no markers 36 on positions C and 8. There is one marker 36 on position 11. The play results in a completed pass for a gain of 15 yards.

EXAMPLE 16

There are no markers 36 on positions C and 8. There is one marker 36 on position 10 and one marker on position 9. The play results in a completed pass for a gain of 30 yards.

EXAMPLE 17

There are no markers 36 on positions C and 8. There are two markers 36 on position 10. The play results in a completed pass for a gain of 30 yards.

EXAMPLE 18

There are no markers 36 on positions C and 8. There is one marker 36 on position 10. The play results in a completed pass for a gain of 50 yards.

EXAMPLE 19

There are no markers 36 on positions C and 8. There is one marker 36 on position 9. The play results in a completed pass and a run for a touchdown.

EXAMPLE 20

There are two markers 36 on position C and one marker 36 on position 8. The play results in a loss of 8 yards with a fumble recovered by the defense.

EXAMPLE 21

There is one marker 36 on position C and two markers 36 on position 8. The play results in an interception after a 15 yard pass.

EXAMPLE 22

The offensive player calls a passing play with starting pass position E and pass reception position 10. There is one marker 36 on position B, one marker 36 on position C and one marker 36 on position D. The play results in an incomplete pass.

The offensive player may also call a screen pass play or a draw run play. Screen and draw plays are only successful if the defensive team executes a blitz. A screen play is selected by indicating either position B, a screen to the right, or position D, a screen to the left. A screen to position B follows the path to positions 6 and 9 for possible additional yardage while a screen to position D follows the path to positions 8 and 11 for possible additional yardage. A draw play is selected by indicating position A. The draw play follows the path to positions 7 and 10 for possible additional yardage.

Referring to FIG. 7, the screen and draw plays are successful for a predetermined number of yards only if the defense executes a blitz. The screen and draw plays may result in a gain of a greater predetermined number of yards following the same rules as a running play as illustrated in FIG. 4. The screen and draw plays are successful even if the defensive team has a marker 36 on the position of the screen or draw play or a marker 36 on the line of scrimmage $\mathbf{30}_1$ upfield from the start of the play. The screen and draw plays result in a loss of yardage if the defensive team has not executed a blitz. There can be no fumble or interception on a screen or draw play.

EXAMPLE 24

The offensive team calls a screen play by selecting position D. The defensive team has no markers 36 in the backfield section and various markers 36 elsewhere. The play results in a loss of eight yards.

EXAMPLE 25

The offensive team calls a screen play by selecting position D. The defensive team has three markers on position D and one marker on position 8. The play results in a gain of 8 yards.

EXAMPLE 26

Same as Example 25, except there is no marker on position 8 and one marker on position 9. The play results in a touchdown.

A field goal may be attempted with the odds of making the field goal proportional to the required distance of the attempt. FIG. 8 illustrates the criteria for a field goal attempt. The offensive team selects a position in the specified downfield section 30 while the defensive team defends against the kick by placing a predetermined number of markers 36 in the specified downfield section 30. The field goal attempt is successful if there are no markers 36 which match the position selected by the offensive team. For example, if the field goal attempt is 24 yards, the offensive team selects a position in one of the downfield sections 30 while the defensive team places 5 markers in the downfield sections 30. The odds of making such a field goal is $6/11$ or 55%. However, if the field goal attempt is 38 yards, the offensive team selects a position along the line of scrimmage $\mathbf{30}_1$ only while the defensive team places 4 markers on the line of scrimmage $\mathbf{30}_1$. The odds of making such a field goal is $1/5$ or 20%. If the field goal attempt is no good, the defensive team takes possession of the football at the line of scrimmage of the kick.

The yardage charts for rushes, passes, screens and draws change to the yards indicated in FIG. 9 when the offensive team has the ball inside the opponent's 10 yard line. Accordingly, any play successful on the line of scrimmage $\mathbf{30}_1$ is good for 4 yards, any play successful in the first secondary $\mathbf{30}_2$ is good for 6 yards, and any play successful in the second secondary $\mathbf{30}_3$ is good for 10 yards. Further, a pass may be completed to the second secondary $\mathbf{30}_3$ even if the defensive team blitzes with 3 or more markers 36 in the backfield section.

The kicking team can call an onside kick in an attempt to recover the ball. The kicking team selects one position along the line of scrimmage 30. The receiving team places 3 markers 36 on desired positions along the line of scrimmage $\mathbf{30}_1$. The onside kick is successful if there are no markers 36 on the position selected by the kicking team. All onside kicks go to the receiving team's 45 yard line. The onside kick can only be used in the fourth quarter by a team trailing in the score.

When the offensive team is sacked or tackled for a loss in their own end zone, a safety occurs with the defense getting 2 points and possession of the football at their own 40 yard line after the ensuing kickoff. Onside kicks cannot be used after a safety.

The offensive team may call a punt play. Regular punts travel 40 yards from the line of scrimmage. The punting team can also call for an angle punt of 35 or 30 yards. There are no fake punts. When the offensive team calls for a punt, the defensive team can call for an attempted block of the punt. The punting team indicates a position in the backfield section 28 while the defensive team places one marker 36 in the backfield section 28. If the marker 36 matches the position selected by the offensive team, the punt is blocked for minus yards as shown in FIG. 6 as if there was a sack, and the football is recovered by the defensive team. If the marker 36 does not match the position selected by the offensive team, the offense can choose: (1) 60 yard punt, or less by fives or (2) defensive penalty for 5 yards and a first down for the offense if 5 or less yards were needed for a first down.

The offensive team has two options after scoring a touchdown. The offensive team may attempt to kick an extra point by following the same rules for a field goal of under five yards. If the kick is good, one point is added to the six point touchdown. The offensive team may also attempt a two point conversion. One play is attempted and if it is successful, two points are added to the six point touchdown.

The time clock 46 is based on a per play system. There are 25 plays per quarter such that after each play the marker 49 in the play in quarter 46B is moved one play. The time clock 46 does not move for kickoffs and extra point attempts. The team with the most points at the end of the fourth quarter is the winner. However, if the game ends in a tie, the winner of a coin toss chooses to kickoff or receive. The first player to score wins.

A shorter version of the game, the redzone game, may also be played. The time clock 46 is not used when playing the redzone game and there are no kickoffs or punts. Each player has one chance on offense each quarter with the football on their opponent's 20 yard line. A turnover or a loss of downs results in the end of that player's turn with the other player getting the football on their opponent's 20 yard line.

It will be appreciated by those skilled in the art that the yardage charts of FIGS. 4–7 may be changed to other reasonable values. For example, the yardage calculations may be made easier by making all of the yardage values multiples of 5 yards Such a change would also eliminate the rule of subtracting a yard for every marker 36 in the backfield section 28 when the result of the play is no gain or a loss.

According to another embodiment of the present invention, the football game may be played as an electronic game. The electronic game would be programmed using conventional methods to add and subtract the yardage automatically and show the field position of the football. Other rules may be added to make the football game even more realistic. For example, instead of 0 yards gained on a running play in which the defense blitzes with 3 or more markers 36, a run would be affected by a blitz only when the blitz was on the same side as the run. Further, the length of a run could be shorten if the defense blitzes to a position which is adjacent or near the starting rush position. For example, the length of a run in which the starting rush position is 1, a blitz to position B would shorten the run by a predetermined number of yards and prevent the gain of even more yardage even though the rush direction position is uncovered. Further yet, the rules for the time clock, punting, and kicking could also be changed to make the football game more realistic.

Having described the invention in detail and by reference to preferred embodiments thereof, it will be apparent that modifications and variations are possible without departing from the scope of the invention which is defined in the appended claims

What is claimed is:

1. A football game apparatus comprising:

an offensive play board and a defensive play board each having a backfield section and a downfield section, said backfield section including a plurality of first play areas and said downfield section including a plurality of second play areas;

an offensive play indicator for selecting a selected offensive play on said offensive play board from a plurality of offensive plays, including passing plays and rushing plays; and each passing play comprising a starting pass position in one of said first play areas and a reception position in one of said second play areas, and each said rushing play comprising a starting rush position in one of said second play areas and a rush direction position in another of said second play areas;

a defensive play indicator for selecting a selected defensive play on said defensive play board from a plurality of defensive plays, each defensive play comprising a desired combination of defensive positions within said first and second play areas in which to defend against said offensive play;

wherein results of a down are determined from said selected offensive play and said selected defensive play.

2. The apparatus of claim 1, wherein said plurality of first play areas comprises a first row having one position, a second row having three positions and a third row having one position, and wherein said plurality of second play areas comprises a line of scrimmage having five positions, a first secondary having three positions and a second secondary having three positions.

3. The apparatus of claim 2, wherein said plurality of offensive plays comprises a field goal play, said offensive play indicator being used to select one of said first and second play areas for said field goal play based on a required distance for completion of said field goal, said defensive play indicator being used to select a predetermined number of said first and second play areas in which to defend against said field goal play based on said required distance for completion of said field goal, wherein said field goal is successful if said area indicated by said offensive play indicator does not match any of said first and second play areas selected to defend against said field goal play.

4. The apparatus of claim 2, wherein said desired combination of defensive positions equals six.

5. The apparatus of claim 1, further comprising a game board, said game board comprising a scoreboard portion and a field portion representing a football field, said scoreboard portion indicating a score for a home team and a visiting team, current down, and a time clock including current quarter and plays within said current quarter, and said field portion indicating current field position and first down position.

6. The apparatus of claim 1, wherein said defensive play board comprises a sheet of magnetically attractive material and said defensive play indicator comprises a plurality of magnetically attractive markers for attachment to said defensive play board.

7. The apparatus of claim 1, wherein said offensive play board comprises an erasable board and said offensive play indicator comprises a writing instrument having erasable ink.

8. A football game apparatus comprising:

a game board, said game board comprising a scoreboard portion and a field board portion representing a football field, said scoreboard portion indicating a score for a home team and a score for a visiting team, current down, and a time clock including current quarter and plays within said current quarter, and said field portion indicating current field position and first down position;

an offensive play board having a backfield section and a downfield section and a defensive play board having a backfield section and a downfield section, said backfield section of each play board including a plurality of first play areas and said downfield section of each play board including a plurality of second play areas, and said plurality of first play areas comprising a first row having one position, a second row having three positions and a third row having one position, and said plurality of second play areas comprising a line of scrimmage having five positions, a first secondary having three positions and a second secondary having three positions;

an offensive play indicator for identifying a selected offensive play on said offensive play board, said selected offensive play being one of a plurality of passing play and rushing plays;

a defensive play indicator for identifying a selected defensive play on said defensive play board;

a passing play being selected using said offensive play indicator to indicate a starting pass position in one of said first play areas and a reception position in one of said positions in said first and second secondaries;

a rushing play being selected using said offensive play indicator to a indicate a starting rush position in one of said positions of said line of scrimmage and a rush direction position in one of said positions of said first secondary;

a defensive play being selected using said defensive play indicator to indicate a desired combination of defensive positions within said first and second play areas to defend against said offensive play, said desired combination of defensive positions being equal to six;

wherein results of a down are determined from said selected offensive and defensive plays.

9. A method for playing a football game comprising:

providing an offensive play board having a plurality of first play areas in a backfield section and a plurality of second play areas in a downfield section;

providing a defensive play board having a plurality of first play areas in a backfield section and a plurality of second play areas in a downfield section;

selecting a desired offensive play on said offensive play board by identifying at least one play area from the total of said first and second play areas;

selecting a desired defensive play on said defensive play board by identifying a desired combination of said first and second play areas as defensive positions;

determining results of a down in response to said selected offensive play and said selected defensive play.

10. The method of claim 9, wherein the act of selecting a desired offensive play comprises the act of selecting a passing play using said offensive play indicator to select a starting pass position in one of said first play areas and a reception position in one of said second play areas.

11. The method of claim 10, wherein the act of determining results of a down comprises the act of determining a result of said passing play based on the following criteria:

a. pass is complete for a predetermined number of yards if said defensive play does not include defensive positions on both of said starting pass position and said reception position;

b. pass is incomplete if said defensive play includes at least one defensive position on said reception position;

c. pass results in a sack for a loss of a predetermined number of yards if said defensive play includes at least one defensive position on said starting pass position; and d. pass results in a turnover for any combination of three defensive positions on said starting pass position and said reception position.

12. The method of claim 11, wherein said pass is complete for a greater predetermined number of yards if said defensive play does not include defensive positions on said starting pass position, said reception position and a finishing pass position, said finishing pass position being adjacent and upfield from said finishing pass position.

13. The method of claim 10, wherein said plurality of first play areas comprise a first row having one position, a second row having three positions and a third row having one position, and wherein said plurality of second play areas comprising a line of scrimmage having five positions, a first secondary having three positions and a second secondary having three positions, the act of selecting a pass play comprises the act of selecting said starting pass position from one of said five positions in said first play area and said reception position in one of said positions in said first and second secondaries.

14. The method of claim 9, wherein the act of selecting a desired offensive play comprises the act of selecting a rushing play using said offensive play indicator to select a starting rush position in one of said second play areas and a rush direction position in another of said second play areas.

15. The method of claim 14, wherein the act of determining results of a down comprises the act of determining a result of said rushing play based on the following criteria:

a. rush results in a gain of a predetermined number of yards if said defensive play does not include at least one defensive position on said starting rush position;

be rush results in a gain of a greater predetermined number of yards if said defensive play does not include defensive positions on either of said starting rush position and said rush direction position;

c. rush results in a zero gain if said defensive play includes one defensive position on said starting rush position;

d. rush results in a loss of a predetermined number of yards if said defensive play includes two defensive positions on said starting rush position; and e. rush results in a turnover if said defensive play includes three defensive positions on said starting rush position.

16. The method of claim 15, wherein said rush results in a gain of an even greater predetermined number of yards if said defensive play does not include defensive positions on said starting rush position, said rush direction position and a finishing rush position, said finishing rush position being adjacent and upfield from said rush direction position.

17. The method of claim 14, wherein the act of selecting a desired offensive play comprises the act of selecting a field goal play using said offensive play indicator to select one of said first and second play areas for said field goal play based on a required distance of said field goal, said defensive play indicator being used to select a predetermined number of said first and second play areas in which to defend against said field goal play based on said required distance of said field goal, the act of determining results of a down comprises the act of determining a result of said field goal play, said field goal being successful if said area indicated by said offensive play indicator does not match any of said predetermined areas indicated by said defensive play indicator.

18. The method of claim 14, wherein said plurality of first play areas comprise a first row having one position, a second row having three positions and a third row having one position, and wherein said plurality of second play areas comprising a line of scrimmage having five positions, a first secondary having three positions and a second secondary having three positions, the act of selecting a rushing play comprises the act of selecting said starting rush position in one of said positions of said line of scrimmage and said rush direction position in one of said positions of said first secondary.

19. The method of claim 9, wherein the act of determining results of a down comprises the act of determining said results electronically.

20. The method of claim 9, wherein said desired combination of defensive positions equals six.

* * * * *